US006968835B2

(12) United States Patent
Lee

(10) Patent No.: US 6,968,835 B2
(45) Date of Patent: Nov. 29, 2005

(54) SLINGSHOT

(76) Inventor: Aldric Kuo-Chun Lee, 4525 Production Dr., Dallas, TX (US) 75235

( * ) Notice: Subject to any disclaimer, the term of this patent is extended or adjusted under 35 U.S.C. 154(b) by 90 days.

(21) Appl. No.: 10/775,375

(22) Filed: Feb. 10, 2004

(65) Prior Publication Data

US 2005/0172944 A1 Aug. 11, 2005

(51) Int. Cl.[7] ..... F41B 3/02
(52) U.S. Cl. ..... 124/20.1
(58) Field of Search ..... 124/20.1, 20.2, 124/20.3

(56) References Cited

U.S. PATENT DOCUMENTS 2,820,444 A * 1/1958 Pedersen ..... 124/20.1
3,983,860 A * 10/1976 Bolton ..... 124/20.1
4,877,007 A * 10/1989 Olson ..... 124/22
4,922,884 A * 5/1990 Ford ..... 124/20.1
5,803,067 A * 9/1998 Ellenburg et al. ..... 124/20.1
5,894,672 A * 4/1999 Ellenburg et al. ..... 33/265
6,209,531 B1 * 4/2001 Boon ..... 124/20.1

* cited by examiner

*Primary Examiner*—John A. Ricci
(74) *Attorney, Agent, or Firm*—Harry C. Post, III; Robinson & Post, LLP

(57) ABSTRACT

A slingshot body for use with an elastic member in slinging a projectile. A fork portion to which the elastic member is to be attached and a gripping portion to be grasped by a user of the slingshot body are provided. Mounting apparatus pivotally connects the fork portion and the gripping portion to one another to allow movement of the gripping portion within the user's hand. The mounting apparatus including a connecting portion for connecting the fork portion and the gripping portion to one another by a predetermined distance sufficient to overcome friction forces created when drawing the elastic member to a shooting position.

37 Claims, 8 Drawing Sheets

SLINGSHOT

BACKGROUND OF THE INVENTION

This invention relates to a slingshot and, more particularly, to a slingshot body for use with an elastic member in slinging a projectile.

Slingshots have been used for many years. Normally, a user of the slingshot wraps a pouch around a projectile, overcomes the resistance caused by elastic members connected to the arms of a forked portion of the body and moves the pouch into a projectile launching position. Unless the user holds the forked portion exactly perpendicular to a projectile release point, the elastic members may apply unequal forces to the pouch. In which event, the projectile will not fly as true a course as the user desires. Further, after the projectile is released, the user may change his or her grip on the slingshot body that will effect the positioning of the forked portion relative to the release point and result in a lack of repeatability in using the slingshot. In order to eliminate these problems, an improved slingshot body is provided for use by a slingshot user.

Accordingly, it is an object of the present invention to provide a slingshot body for use with an elastic member in slinging a projectile. Since the slingshot body has a fork portion pivotally connected to a gripping portion, the fork portion is disposed perpendicular to a user's arm and equal force is applied to the pouch supporting the projectile and thereby improve the flight of the projectile toward the target.

Further, it is an object of the prevent invention to provide an improved slingshot body with increased accuracy by inhibiting frictional forces created in a pivotal mounting of the fork portion and the gripping portion and in a pivotal mounting of the elastic member to the fork portion.

Further, it is an object of the prevent invention to provide a slingshot body with an improved wrist brace allowing a user of the slingshot to more easily grasp a slingshot.

BRIEF SUMMARY OF THE INVENTION

In accordance with the present invention, there is provided a slingshot body for use with an elastic member in slinging a projectile. A fork portion to which the elastic member is to be attached and a gripping portion to be grasped by a user of the slingshot body are provided. Mounting apparatus pivotally connects the fork portion and the gripping portion to one another to allow movement of the gripping portion within the user's hand without effecting the force applied on each side of the pouch by the elastic members.

Further, in accordance with the present invention, there is provided a slingshot body for use with an elastic member in slinging a projectile. A fork portion to which the elastic member is to be attached and a gripping portion to be grasped by a user of the slingshot body are provided. Pivotal connecting apparatus is then used to pivotally connect the elastic member to said fork portion.

Further, in accordance with the present invention, there is provided a slingshot body for use with an elastic member in slinging a projectile. A fork portion to which the elastic member is to be attached and a gripping portion to be grasped by a user of the slingshot body are provided. A stabilizing member is used to inhibit undesired movement of said fork portion.

Further, in accordance with the present invention, there is provided a slingshot body for use with an elastic member in slinging a projectile. A fork portion to which the elastic member is to be attached and a gripping portion to be grasped by a user of the slingshot body. A mounting apparatus pivotally connects the fork portion and the gripping portion to one another. The mounting apparatus includes a connecting portion for connecting the fork portion and the gripping portion to one another by a predetermined distance sufficient to overcome friction forces created in the mounting apparatus when drawing the elastic member to a shooting position.

Further, in accordance with the present invention, there is provided a slingshot body for use with an elastic member in slinging a projectile. A fork portion to which the elastic member is to be attached and a gripping portion to be grasped by a user of the slingshot body. A pivotal connecting apparatus pivotally connects the elastic member to the fork portion. The pivotal connecting apparatus includes an elongated connecting member pivotally connected in close proximity to an outboard end of the fork portion and the elongated connecting member has a length sufficient to overcome friction forces created when drawing the elastic member to a shooting position.

Further, in accordance with the present invention, there is provided a slingshot body for use with an elastic member in slinging a projectile. A fork portion to which the elastic member is to be attached and a gripping portion to be grasped by a user of the slingshot body. A wrist brace for providing stability is pivotally connected to the gripping portion. The wrist brace is connected to the gripping portion and has first, second, third and fourth portions. The first portion extends generally transverse ly away from said gripping portion when in a shooting position and the second, third and fourth portions partially circumscribe an open area with a size sufficient to receive a portion of a forearm of a user of the slingshot body.

BRIEF DESCRIPTION OF THE SEVERAL VIEWS OF THE DRAWING

Objects and advantages of the invention will become apparent upon reading the following detailed description and upon reference to the drawings, wherein like reference characters are used throughout to designate like parts.

DETAILED DESCRIPTION OF THE INVENTION

Figure 1:
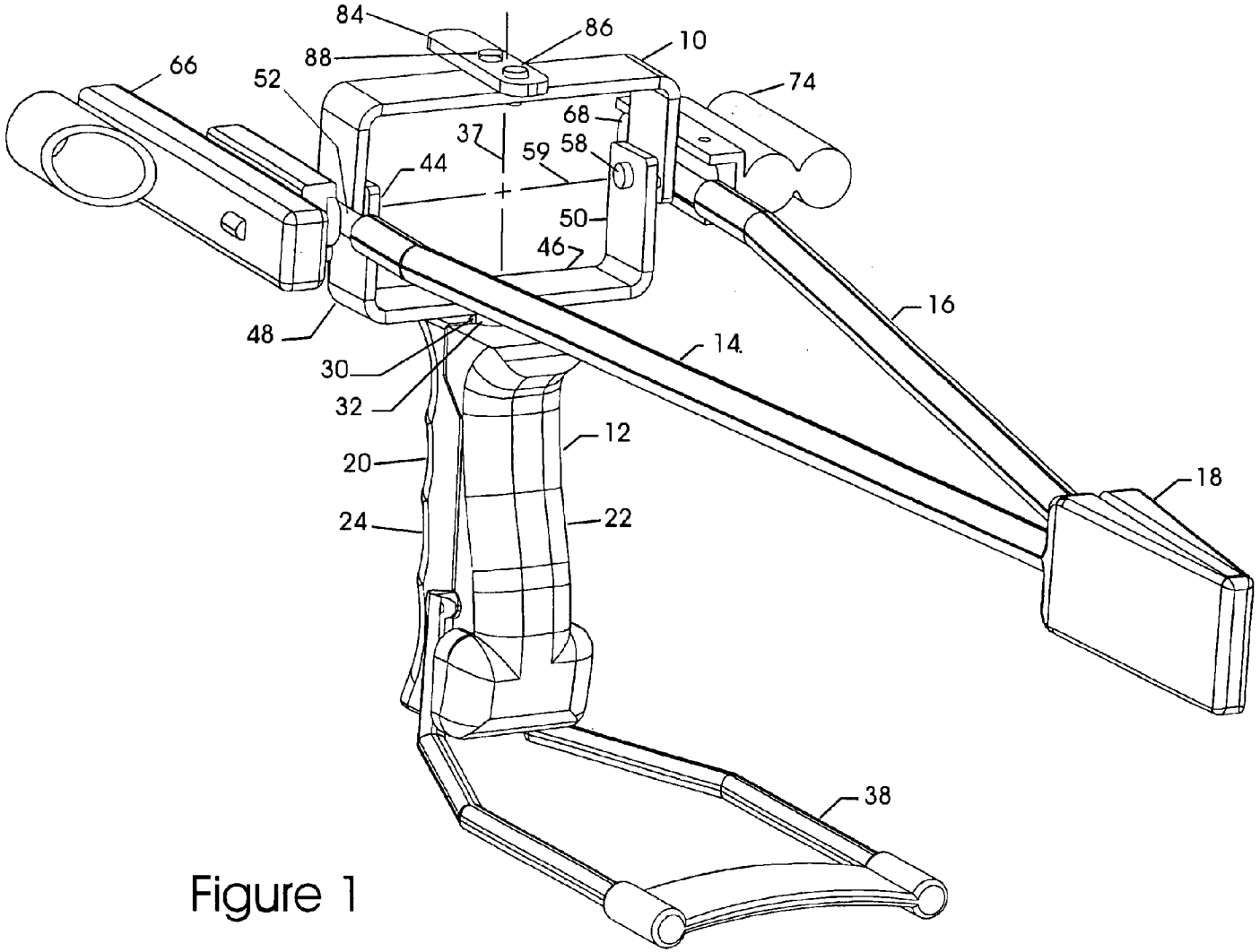
FIG. 1 is a perspective view of a slingshot constructed according to the present invention with separate sights.

Turning now to the drawing, there is shown a slingshot 10 with a slingshot body 12, first and second conventional elastic members 14 and 16, respectively, and a conventional pouch 18 for supporting a projectile (not shown).

Figure 2:
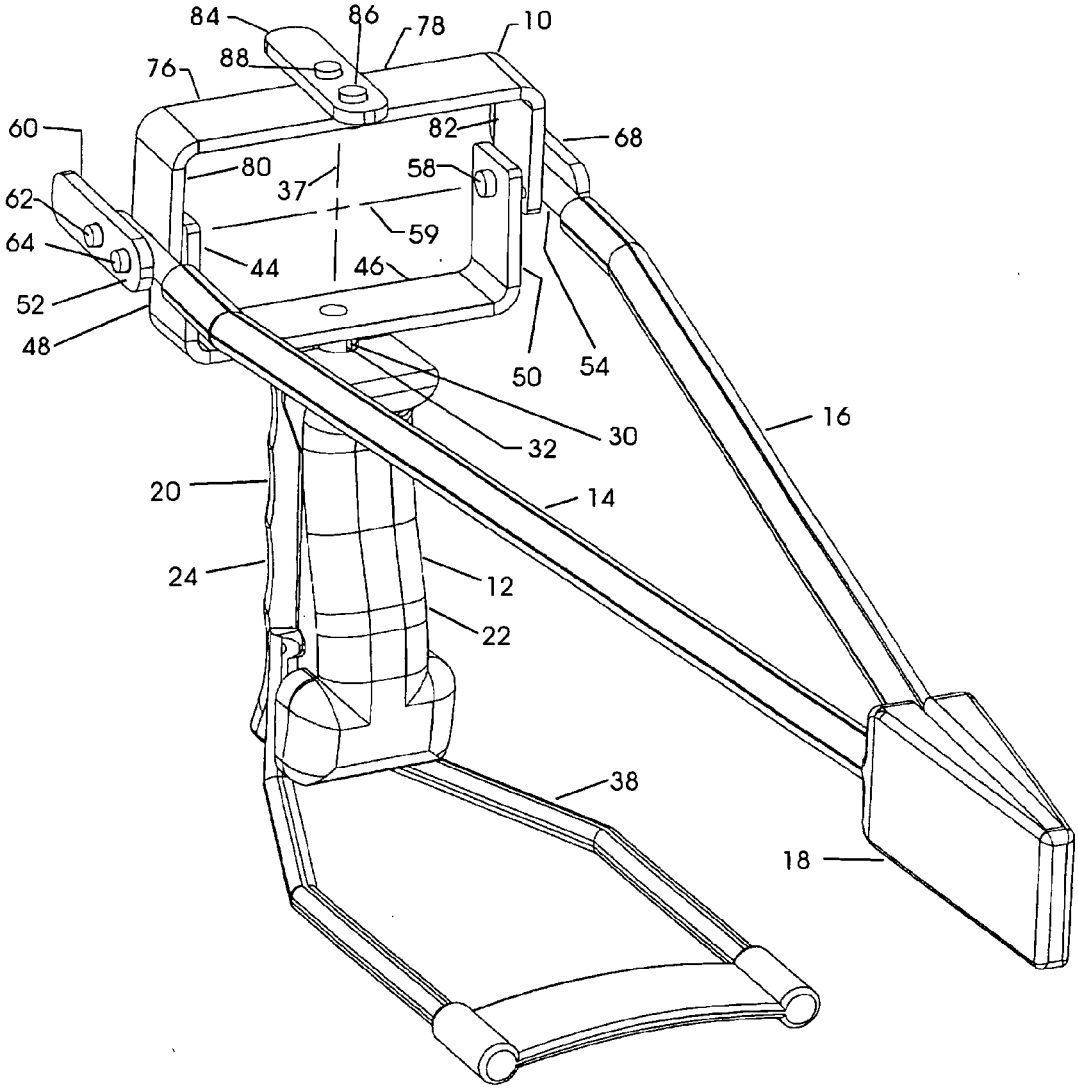
FIG. 2 is a perspective view of a slingshot constructed according to the present invention without sights.
Figure 3:
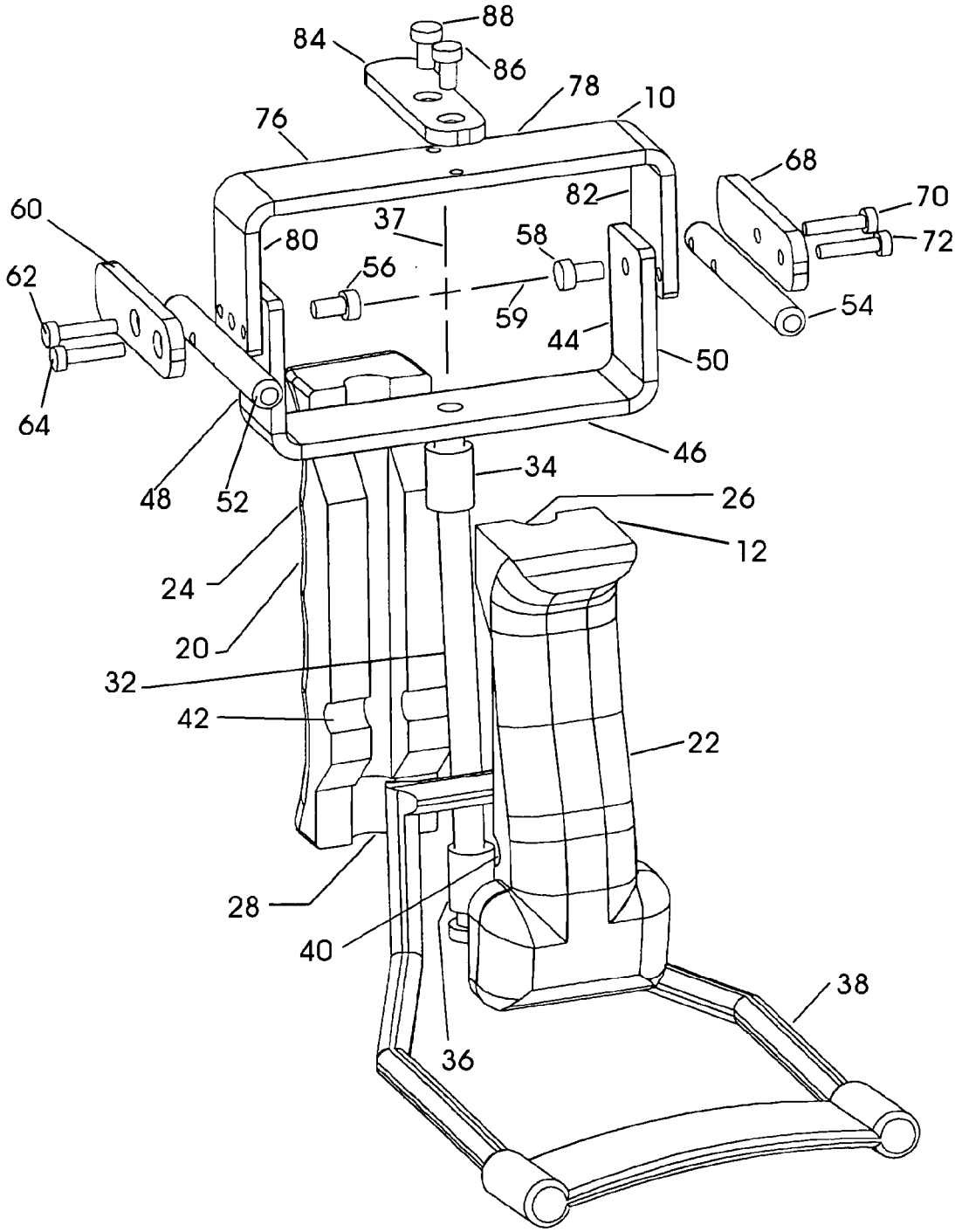
FIG. 3 is an exploded perspective view of a portion of the slingshot shown in FIG. 2.

As best seen in FIG. 2, slingshot body 12 has a gripping portion 20 to be grasped by a user of slingshot 10 and is elongated with a length sufficient to be engaged and gripped by a hand of the user of slingshot 10. Gripping portion 20 is constructed with a user side portion 22 generally facing toward the user and a target side portion 24 generally facing away from the user. User side portion 22 and target side portion 24 are constructed to complementary engage one another and form elongated gripping portion 20 when joined together in a conventional manner. User side portion 22 is constructed to generally conform to a palm of a user's hand when gripping portion 20 is held in the user's hand and target side portion 24 is constructed to form finger grips when gripping portion 20 is held in the user's hand. A complementary groove 26 and 28 is provided in each portion 22 and 24, respectively, to form an aperture 30 that extends into and through gripping portion 20 along its elongated length.

An axle 32 is disposed in upper bearing ring 34 and lower bearing ring 36 to permit rotation of the axle. Upper and lower bearing rings 34 and 36 are disposed within aperture 30 and connected to gripping portion 30 so that axle 32 is mounted for pivotal movement around an elongate axis 37 created by gripping portion 30.

When desired, a wrist support 38 can be pivotally mounted to gripping portion 20 by providing complementary grooves 40 and 42 in each portion 22 and 24, respectively. When wrist support 38 is pivotally connected to gripping portion 20, it can be rotated into the appropriate shooting position so that a user of slingshot 10 is provided support at his or her wrist in a conventional manner.

A fork portion 44 of slingshot 10 is pivotally connected to axle 32. Fork portion has a generally U-shaped configuration with a base 46 and generally upturned arms 48 and 50 that extend substantially transverse to base 46. Connected to base 46 is axle 32, which is disposed substantially equidistant between arms 48 and 50 and extends away from base 46 in a direction opposite to the direction that arms 48 and 50 extend away from base 46.

First and second elongated connecting rods 52 and 54 are pivotally connected at one end in close juxtaposition to the outboard ends of upturned arms 48 and 50, respectively, by first and second connecting pins 56 and 58, respectively, and form a pivotal axis 59. Connected to the other end of rod 52 in a conventional manner is one end of elastic member 14 and to the other end of rod 54 in a conventional manner is one end of elastic member 16. The other ends of elastic members 14 and 16 are connected to pouch 18 in a conventional manner.

A first elongated sight mounting bracket 60 is connected to connecting rod 52 by pins 62 and 64 and pivotally rotates around first connecting pin 56 with connecting rod 52. Sight mounting bracket 60 has a configuration and size permitting a first conventional sight 66 to be secured to bracket 60. Examples of conventional sights that may be used as sight 66 are an electronic point sight that is sold under the name MAX SPEED by Daisy Manufacturing Company or a Laser Guide that is sold under the name AIR SHOT by Sighting Systems Instruments, LLC.

A second elongated sight mounting bracket 68 is connected to connecting rod 54 by pins 70 and 72 and pivotally rotates around second connecting pin 58 with connecting rod 54. Sight mounting bracket 68 has a configuration and size permitting a second conventional sight 74 to be secured to bracket 68. Examples of conventional sights that may be used as sight 74 are an electronic point sight that is sold under the name MAX SPEED by Daisy Manufacturing Company or a Laser Guide that is sold under the name AIR SHOT by Sighting Systems Instruments, LLC.

When desired, a stabilizing member 76 is used to inhibit undesired movement of fork portion 44. The preferred stabilizing member 76 has an inverted generally U-shaped configuration with a base 78 and generally down-turned arms 80 and 82 that extend substantially transverse to base 78. First and second arms 80 and 82, respectively, are attached to first and second connecting rods 52 and 54, respectively, by pins 62 and 64 and pins 70 and 72 to pivotally move with connecting rods 52 and 54.

When stabilizing member 76 is used, a third elongated sight mounting bracket 84 is connected to base 78 by securing pins 86 and 88 at a location where elongate axis 37 crosses base 78. Sight mounting bracket 84 has a configuration and size permitting a conventional sight (not shown) to be attached thereto. Examples of conventional sights that may be mounted to bracket 84 are an electronic point sight that is sold under the name MAX SPEED by Daisy Manufacturing Company or a Laser Guide that is sold under the name AIR SHOT by Sighting Systems Instruments, LLC.

Figure 4:
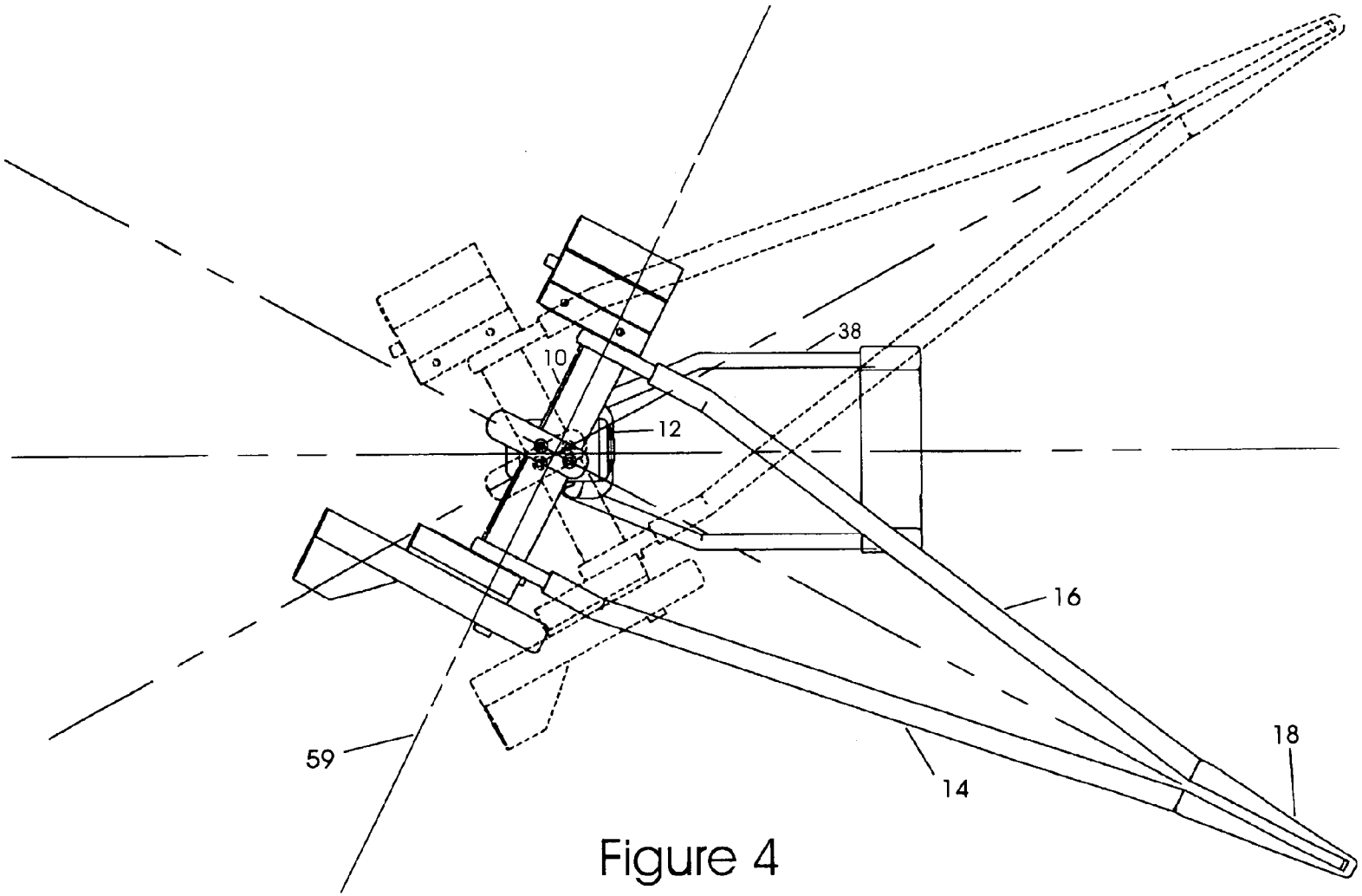
FIG. 4 is a top plan view of the slingshot shown in FIG. 1.
Figure 5:
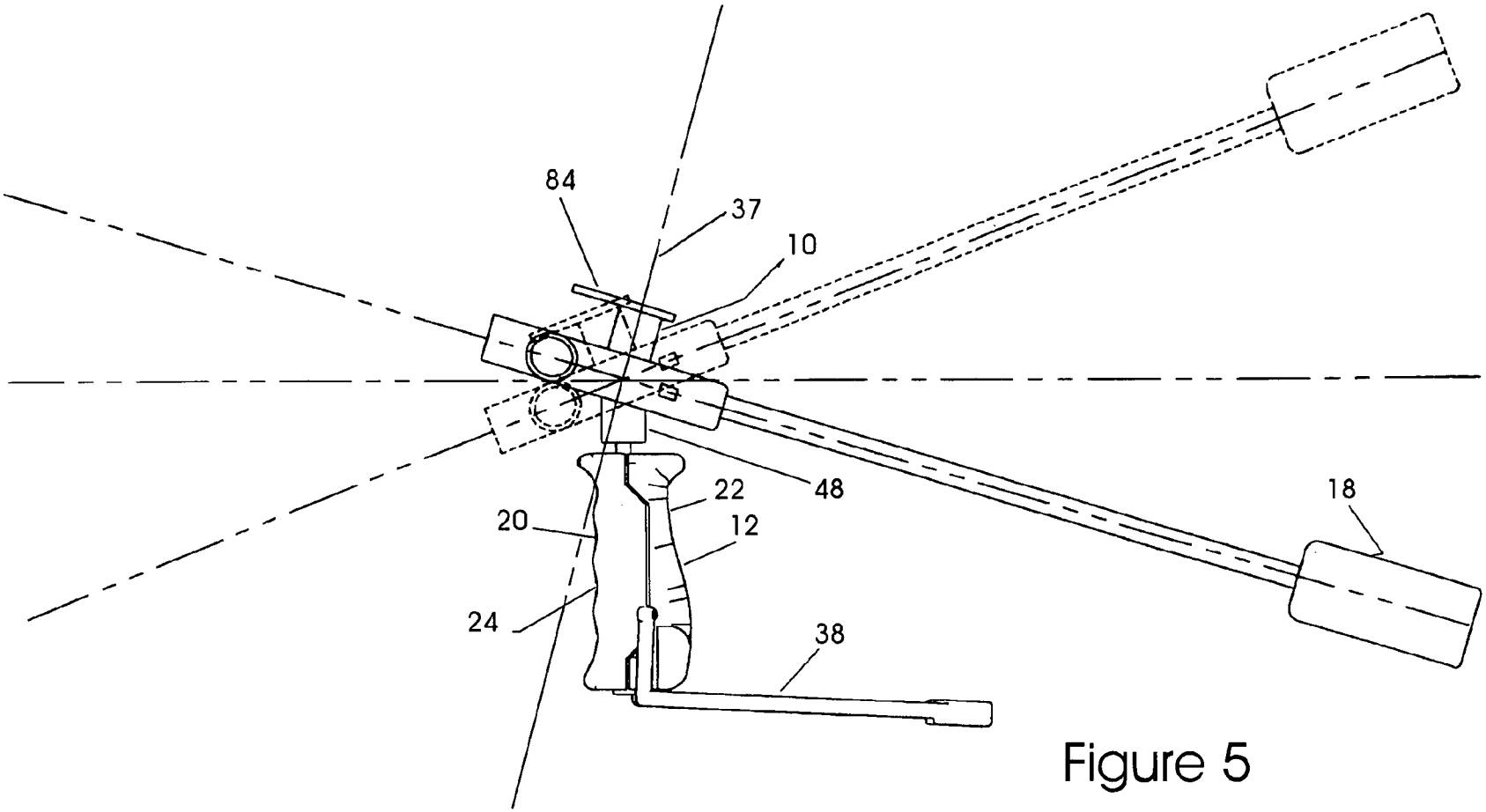
FIG. 5 is a side elevation view of the slingshot shown in FIG. 1.

As shown in FIGS. 4 and 5, when slingshot 10 is used, a user inserts his or her hand through wrist support 38 and grasps gripping portion 20 in a conventional manner. A projectile is then positioned in pouch 18 in a conventional manner and pouch 18 moved to a launching position, as indicated in solid outline. Should gripping portion 20 or pouch 18 be at a different launching position or point, as indicated in dotted outline, than previous launching positions, fork portion 44 of slingshot 10 rotates to align pouch 18 to be equidistant from arms 48 and 50. By this rotation into alignment, the launch point of pouch 18 is equidistant from arms 48 and 50 and the force provided by elastic members 14 and 16 should be equal. Thus, each projectile thrown from slingshot 10 should pass through the point where elongate axis 37 crosses pivotal axis 59 to, thereby, provide enhanced performance for the user through better repeatability of shots.

Moreover, the projectile should pass through the point where elongate axis 37 crosses pivotal axis 59 when slingshot 10 is held by the user in a generally vertical or upright position with a sight being used mounted on third mounting bracket 84 or when slingshot 10 is rotated 90° in a generally horizontal position with a sight being used mounted on first or second mounting brackets 60 and 68, respectively.

Further, by constructing slingshot body 10 with elongate axis 37 and pivotal axis 59 and these axes are in the same plane, arms 48 and 50 of fork portion 44 will be perpendicular to the launch point of pouch 18 when a user of slingshot 10 moves pouch 18 into a launch position, as shown in FIGS. 4 and 5.

Figure 6:
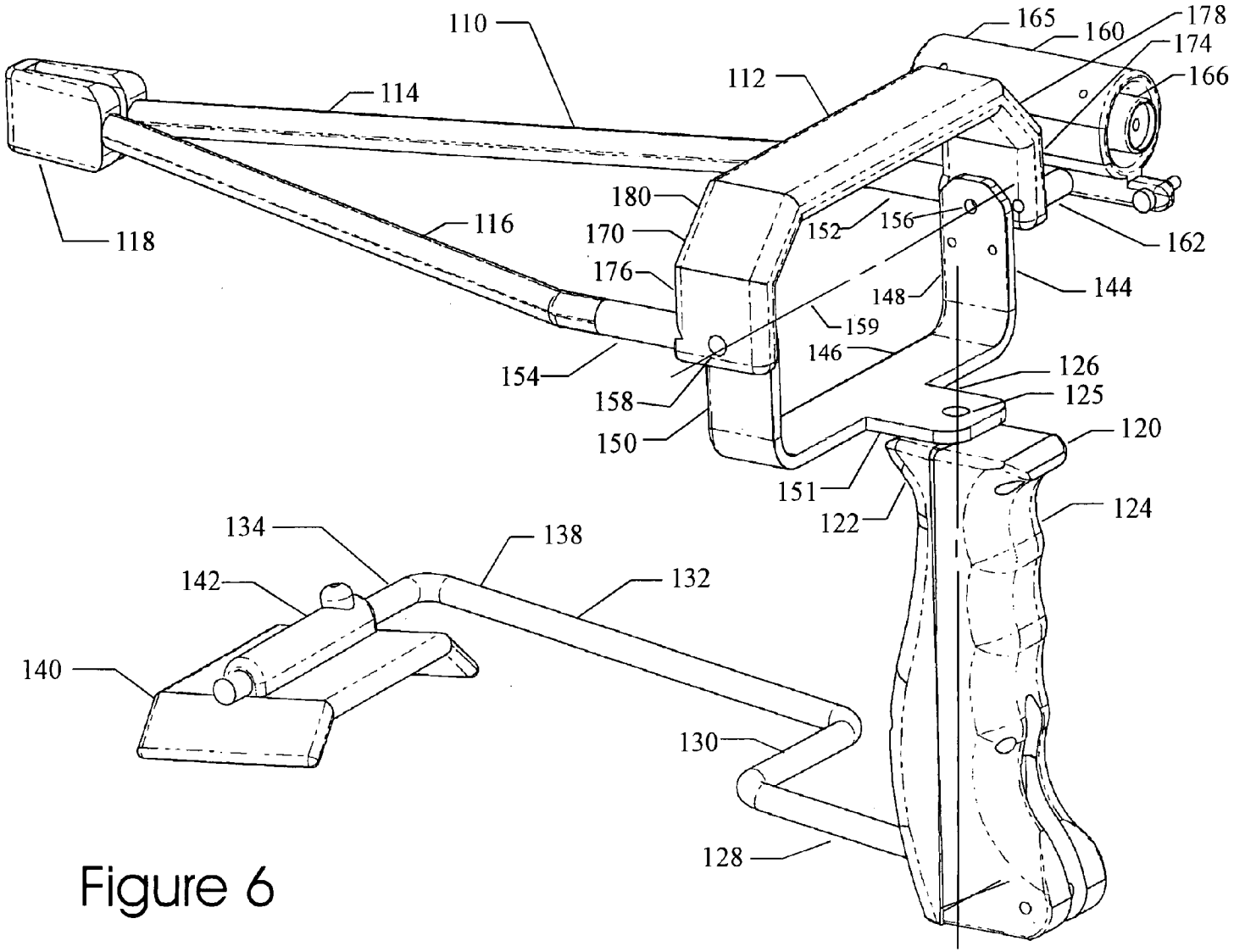
FIG. 6 is a perspective view of a second embodiment of a slingshot constructed according to the present invention.
Figure 7:
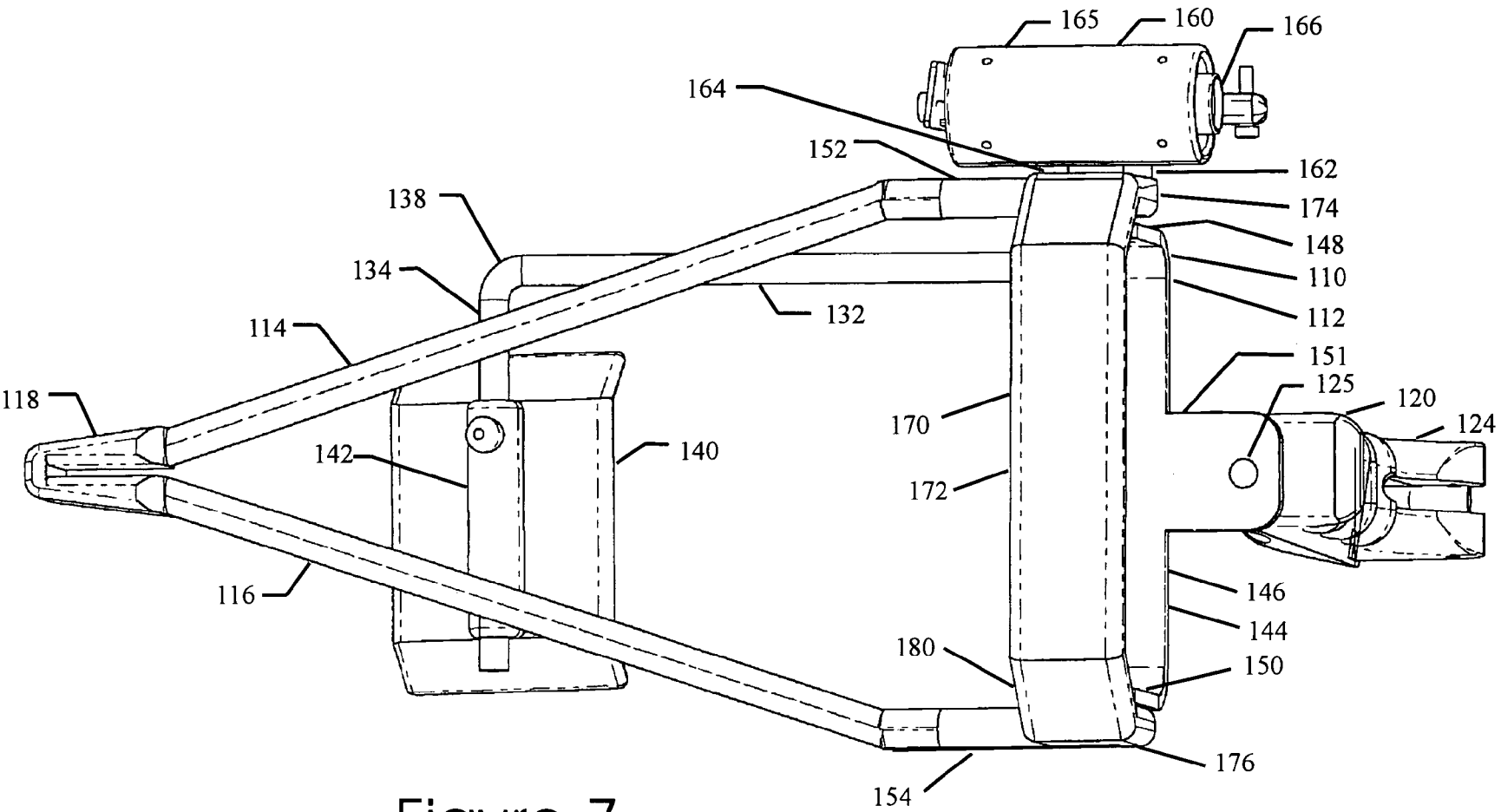
FIG. 7 is a top plan view of the slingshot shown in FIG. 6.
Figure 8:
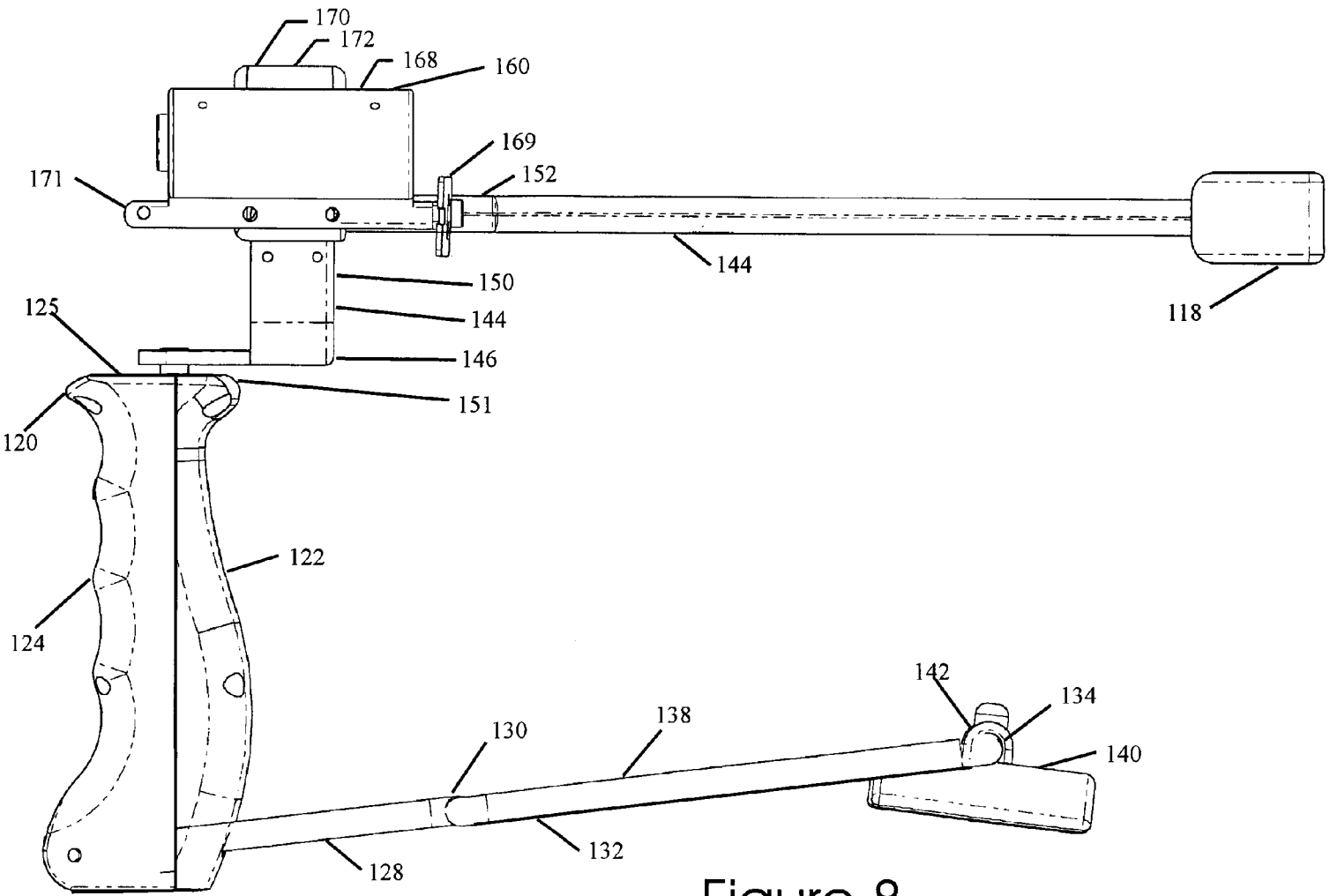
FIG. 8 is a side elevation view of the slingshot shown in FIG. 6.

Turning now to FIGS. 6–8, there is shown a second embodiment of a slingshot 110 with a slingshot body 112, first and second conventional elastic members 114 and 116, respectively, and a conventional pouch 118 for supporting a projectile (not shown). Slingshot body 112 has a gripping portion 120 to be grasped by a user of slingshot 110 and is elongated with a length sufficient to be engaged and gripped by a hand of the user of slingshot 110. Gripping portion 120 is constructed with a user side portion 122 generally facing toward the user and a target side portion 124 generally facing away from the user. User side portion 122 and target side portion 124 are constructed to complementary engage one another and form elongated gripping portion 120 when joined together in a conventional manner. User side portion 122 is constructed to generally conform to a palm of a user's hand when gripping portion 120 is held in the user's hand and target side portion 124 is constructed to form finger grips when gripping portion 120 is held in the user's hand.

As previously described and shown in relation to first embodiment 10, a complementary groove is provided in each portion 122 and 124, respectively, to form an aperture that extends into and through gripping portion 120 along its elongated length. An axle 125 is disposed in an upper bearing ring and a lower bearing ring to permit rotation of the axle. Upper and lower bearing rings are disposed within the aperture and connected to gripping portion 120 so that the axle is mounted for pivotal movement around an elongate axis 126 created by axle 125 in gripping portion 120.

A wrist support 138 is pivotally mounted to gripping portion 120 by providing complementary grooves in each portion 122 and 124, respectively, as shown and described in connection with the first embodiment 10. Thus, wrist support 138 is pivotally connected to gripping portion 120 and is rotated into a shooting position (as shown in FIGS. 6–8) so that a user of slingshot 110 is provided support at his or her wrist when shooting or is rotated into a storage or carrying position so that the slingshot is relatively compact when it is being transported or stored. Preferably, wrist brace 138 is constructed from a relatively inflexible material in the form of a rod and arranged in a generally C-shaped configuration that partially circumscribes an open area. The open area within the C-shaped configuration has a size sufficient to receive a portion of a forearm of a user of the slingshot body and one side of the C-shape is open to permit insertion of the user's forearm into the open area. To form this open area, wrist brace 138 has a first portion 128 that extends away from gripping portion 120 when in the shooting position. A second portion 130 of wrist brace 138 extends substantially transversely to first portion 128. A third portion 132 of wrist brace 138 extends substantially transversely to second portion 130 and extends substantially parallel to first portion 128. A fourth portion 134 of wrist brace 138 extends for a fourth distance substantially transverse to third portion 132 and extends substantially parallel to second portion 130. Fourth portion 134 has a length sufficient to extend over a forearm (not shown) of the user.

To inhibit injury to the user, a pad member 140 for distributing pressure across a larger area on the user's forearm is pivotally connected to fourth portion 134 of wrist brace 138. Fourth portion 134 of the rod creating wrist support 138 is passed through a housing 142 connected to pad member 140 so that pad member 140 may be adjusted to provide relative comfort for various wrists for various sized users as well as adjusted when wrist support 138 is moved into the storage position.

A fork portion 144 of slingshot 110 is pivotally connected to gripping portion 120. Fork portion 144 is a generally U-shaped configuration with a base 146 and generally upturned arms 148 and 150 that extend substantially transverse to base 146.

It has been discovered that undesirable friction forces may be created in prior art pivotal connections of the fork portion to the gripping portion when drawing the elastic members into a shooting position, which prevents slingshot 110 from being as accurate as one desires. To overcome these undesirable friction forces, a connecting member 151 is pivotally connected to gripping portion 120 by axle 125 to provide an off-set mounting for fork portion 144 relative to gripping portion 120. Connecting member 151 is provided on fork portion 144 substantially equidistant between arms 148 and 150 and disposed in a plane formed by base 146 to extend away from fork portion 144 toward the target and thereby provide an off-set mounting with gripping portion 120. To obtain the previously mentioned desired result, the off-set mounting is set at a predetermined distance so as to override the friction forces. It has been discovered that the desired result is accomplished when the predetermined distance (the distance between elongate or pivotal axis 126 and the midway point between the target edge and user edge of base 146) is at least about 0.75 inches (1.905 cm). However, it is also desired that this predetermined distance be sufficiently small so as to allow a relatively compact storing position. It is, therefore, preferred that this predetermined distance be less than about 1.25 inches (3.175 cm). It is most preferred that this predetermined distance be about 1.00 inch (2.54 $\mu$m).

First and second elongated connecting members or rods 152 and 154 are pivotally connected at one end in close juxtaposition to the outboard ends of upturned arms 148 and 150, respectively, by first and second connecting pins 156 and 158, respectively, and form a pivotal axis 159 extending through arms 148 and 150. Connected to the other end of rod 152 in a conventional manner is one end of elastic member 114 and to the other end of rod 154 in a conventional manner is one end of elastic member 116. The other ends of elastic members 114 and 116 are connected to pouch 118 in a conventional manner.

It has been discovered that undesirable friction forces may be created in prior art pivotal connections of the connecting rods to the fork portion when drawing the elastic members into a shooting position, which prevents slingshot 110 from being as accurate as one desires. To overcome these undesirable friction forces, connecting members or rods 152 and 154 must an elongated length with a sufficient distance to connect the elastic members 114 and 116 and thereby override the undesirable friction forces. It has been discovered that this desired result is accomplished when this distance (the distance from the elastic member connecting end of member 152 to the pivotal axis 159) is at least about 1.00 inches (2.54 cm). However, it is also desired that this distance be sufficiently small so as to allow a relatively compact storing position. Therefore, it is preferred that this predetermined distance be less than about 2.00 inches (5.08 cm). It is most preferred that this distance be about 1.50 inches (3.81 cm).

In second embodiment 110, a single sight mounting bracket 160 is connected to connecting rod 152 by mounting pins 162 and 164 while pivotally rotating around first connecting pin 156. Sight mounting bracket 160 has a configuration and size permitting a laser light 166 to be secured in a tubular bracket 168 by adjusting screws (not shown) so as to adjust light 166 within bracket 168. A square edged open rear gun sight 169 is provided on the rear end of bracket 160 and a screw 171 acting as the front blade side is provided on the front end bracket 160.

When desired, a stabilizing member 170 is used to inhibit undesired movement of fork portion 144. The preferred stabilizing member 170 has an inverted generally U-shaped configuration with a base 172, generally down-turned arms 174 and 176 that extend substantially transverse to base 172 with intermediate arm portions 178 and 180 extending between arms 174 and 176, respectively, and base 172. It is preferred that first and second arms 174 and 176, respectively, and first and second connecting rods 152 and 154, respectively, be constructed as a unitized construction and pivotally connected to arms 148 and 150 of fork portion 144 by connecting pins 156 and 158.

When slingshot 110 is used, a user moves wrist support 138 into the shooting position and moves his or her lower arm through the C-shaped wrist support and grasps gripping portion 120 with his or her hand. A projectile is then positioned in pouch 118 in a conventional manner and pouch 118 moved to a launching position. Should gripping portion 120 or pouch 118 be at a different launching position or point than previous launching positions, fork portion 144 of slingshot 110 rotates around elongate axis 126 to align pouch 118 to be equidistant from arms 148 and 150. By this rotation into alignment, the launch point of pouch 118 is equidistant from arms 148 and 150 and the force provided by elastic members 114 and 116 should be equal. Thus, each projectile thrown from slingshot 10 should pass through the point where pivotal axis 159 crosses a plane formed by extending elongate axis 126 to the projectile, which provides enhanced performance for the user through better repeatability of shots.

The invention having been described, what is claimed is:

1. A slingshot body for use with an elastic member in slinging a projectile, comprising: a fork portion to which the elastic member is to be attached; a gripping portion to be grasped by a user of the slingshot body; and an off-set mounting apparatus pivotally connecting said fork portion and said gripping portion to one another for providing an off-set mounting for said fork portion relative to said gripping portion, said off-set mounting apparatus including a connecting member for connecting said fork portion and said gripping portion to one another by a predetermined distance sufficient to overcome friction forces created in the mounting apparatus when drawing the elastic member to a shooting position.

2. The slingshot body set forth in claim 1, further comprising: the connecting member of said mounting apparatus having a size sufficient to connect said fork portion and said gripping portion to one another with the predetermined distance being at least about 0.75 inches.

3. The slingshot body set forth in claim 1, further comprising: the connecting member of said mounting apparatus having a size sufficient to connect said fork portion and said gripping portion to one another with the predetermined distance being between about 0.75 inches and about 1.25 inches.

4. The slingshot body set forth in claim 1, further comprising: the connecting member of said mounting apparatus having a size sufficient to connect said fork portion and said gripping portion to one another with the predetermined distance being about 1.00 inch.

5. The slingshot body set forth in claim 1, further comprising: the connecting member of said mounting apparatus being elongated.

6. The slingshot body set forth in claim 5, further comprising: the elongated connecting member of said mounting apparatus being disposed to extend substantially transverse to said fork portion.

7. The slingshot body set forth in claim 6, further comprising: the elongated connecting member of said mounting apparatus having a length of at least about 0.75 inches.

8. The slingshot body set forth in claim 6, further comprising: the elongated connecting member of said mounting apparatus having a length of between about 0.75 inches and about 1.25 inches.

9. The slingshot body set forth in claim 6, further comprising: the elongated connecting member of said mounting apparatus having a length of about 1.00 inch.

10. The slingshot body set forth in claim 1, further comprising: the elongated connecting member of said mounting apparatus being disposed to pivot in a substantially transverse direction around a pivotal axis extending through said gripping portion.

11. The slingshot body set forth in claim 1, further comprising: a sight mounting bracket for attaching a sight to said fork portion.

12. The slingshot body set forth in claim 1, further comprising: a stop member to prevent pivotal movement of said fork portion beyond a chosen angle relative to said gripping portion.

13. The slingshot body set forth in claim 1, further comprising: pivotal connecting apparatus for pivotally connecting the elastic member to said fork portion.

14. The slingshot body set forth in claim 13, further comprising: a sight mounting bracket for attaching a sight in close proximity to said pivotal connecting apparatus.

15. The slingshot body set forth in claim 1, further comprising: a stabilizing member for inhibiting undesired movement of said fork portion.

16. The slingshot body set forth in claim 1, further comprising: pivotal connecting apparatus for pivotally connecting the elastic member to said fork portion, said pivotal connecting apparatus including an elongated connecting member pivotally connected in close proximity to an outboard end of said fork portion, the elongated connecting member having a length sufficient to overcome friction forces created when drawing the elastic member to a shooting position.

17. A slingshot body for use with an elastic member in slinging a projectile, comprising: a fork portion to which the elastic member is to be attached; a gripping portion to be grasped by a user of the slingshot body; a stabilizing member for inhibiting undesired movement of said fork portion; and pivotal connecting apparatus for pivotally connecting the elastic member to said fork portion, said pivotal connecting apparatus including an elongated connecting member pivotally connected in close proximity to an outboard end of said fork portion, the elongated connecting member having a length sufficient to overcome friction forces created when drawing the elastic member to a shooting position.

18. The slingshot body set forth in claim 17, further comprising: the elongated connecting member of said pivotal connecting apparatus having a length of at least about 1.00 inches.

19. The slingshot body set forth in claim 17, further comprising: the elongated connecting member of said pivotal connecting apparatus having a length of between about 1.00 inches and about 2.00 inches.

20. The slingshot body set forth in claim 17, further comprising: the elongated connecting member of said pivotal connecting apparatus having a length of about 1.50 inches.

21. The slingshot body set forth in claim 17, further comprising: a sight mounting bracket for attaching a sight in close proximity to said pivotal connecting apparatus.

22. The slingshot body set forth in claim 17, further comprising: said pivotal connecting apparatus including first and second pivotal connectors disposed on said fork portion.

23. The slingshot body set forth in claim 22, further comprising: a sight mounting bracket for attaching a sight in close proximity to each of the first and second pivotal connectors.

24. The slingshot body set forth in claim 22, further comprising: a stabilizing member for inhibiting undesired movement of said fork portion.

25. The slingshot body set forth in claim 17, further comprising: said fork portion having first and second outboard ends; pivotal connecting apparatus for pivotally connecting the elastic member in close proximity to the first and second outboard ends of said fork portion; and said stabilizing member for inhibiting undesired movement of said fork portion being pivotally connected in close proximity to said pivotal connecting apparatus.

26. The slingshot body set forth in claim 17, further comprising: mounting apparatus pivotally connecting said fork portion and said gripping portion to one another, said mounting apparatus including a connecting member for connecting said fork portion and said gripping portion to one another by a predetermined distance sufficient to overcome friction forces created in the mounting apparatus when drawing the elastic member to a shooting position.

27. A slingshot body for use with an elastic member in slinging a projectile, comprising: a fork portion to which the elastic member is to be attached; a gripping portion to be grasped by a user of the slingshot body; and a wrist brace for providing stability pivotally connected to said gripping portion, said wrist brace being connected to said gripping portion and having first, second, third and fourth portions, the first portion extending generally transversely away from said gripping portion when in a shooting position and the second, third and fourth portions partially circumscribing an open area with a size sufficient to receive a portion of a forearm of a user of the slingshot body.

28. The slingshot body set forth in claim 27, further comprising: a pad member for inhibiting injury to the user connected to said wrist brace.

29. The slingshot body set forth in claim 27, further comprising: said wrist brace being pivotally connected to said gripping portion and movable between a storage position and the shooting position.

30. The slingshot body set forth in claim 27, further comprising: said wrist brace being constructed from a relatively inflexible material to form a generally C-shaped configuration, and the first portion of said wrist brace extending away from said gripping portion when in the shooting position and the second portion of said wrist brace extending substantially transversely to the first portion, the third portion of said wrist brace extending substantially transversely to the second portion and extending substantially parallel to the first portion and the fourth portion of said wrist brace extending for a fourth distance substantially transverse to the third portion and extending substantially parallel to the second portion, the fourth portion having a length sufficient to extend over the forearm of the user.

31. The slingshot body set forth in claim 30, further comprising: a pad member for inhibiting injury to the user connected to the fourth portion of said support rod.

32. The slingshot body set forth in claim 27, further comprising: a sight mounting bracket for attaching a sight in close proximity to a pivotal connecting apparatus.

33. The slingshot body set forth in claim 27, further comprising: a pivotal connecting apparatus including first and second pivotal connectors disposed on said fork portion.

34. The slingshot body set forth in claim 33, further comprising: a sight mounting bracket for attaching a sight in close proximity to each of the first and second pivotal connectors.

35. The slingshot body set forth in claim 33, further comprising: a stabilizing member for inhibiting undesired movement of said fork portion.

36. The slingshot body set forth in claim 27, further comprising: said fork portion having first and second outboard ends; pivotal connecting apparatus for pivotally connecting the elastic member in close proximity to the first and second outboard ends of said fork portion; and a stabilizing member for inhibiting undesired movement of said fork portion pivotally connected in close proximity to said pivotal connecting apparatus.

37. The slingshot body set forth in claim 27, further comprising: mounting apparatus pivotally connecting said fork portion and said gripping portion to one another, said mounting apparatus including a connecting member for connecting said fork portion and said gripping portion to one another by a predetermined distance sufficient to overcome friction forces created in the mounting apparatus when drawing the elastic member to a shooting position; and pivotal connecting apparatus for pivotally connecting the elastic member to said fork portion, said pivotal connecting apparatus including an elongated connecting member pivotally connected in close proximity to an outboard end of said fork portion, the elongated connecting member having a length sufficient to overcome friction forces created when drawing the elastic member to a shooting position.

* * * * *